US005348093A

United States Patent [19]

Wood et al.

[11] Patent Number: 5,348,093

[45] Date of Patent: Sep. 20, 1994

[54] CEMENTING SYSTEMS FOR OIL WELLS

[75] Inventors: Edward T. Wood, Kingwood; George O. Suman, Jr.; Robert T. Brooks, both of Houston, all of Tex.

[73] Assignee: CTC International, Houston, Tex.

[21] Appl. No.: 932,252

[22] Filed: Aug. 19, 1992

[51] Int. Cl.[5] ..... E21B 33/14; E21B 47/06

[52] U.S. Cl. ..... 166/250; 166/285; 73/151

[58] Field of Search ..... 166/285, 253, 250; 73/151, 155

[56] References Cited

U.S. PATENT DOCUMENTS

| | | | |
|---|---|---|---|
| 3,420,299 | 1/1969 | Cloud | 166/285 X |
| 4,376,463 | 3/1983 | Pattillo et al. | 166/285 |
| 4,440,226 | 4/1984 | Suman, Jr. | 166/250 |
| 4,655,286 | 4/1987 | Wood | 166/285 |

*Primary Examiner*—Stephen J. Novosad
*Attorney, Agent, or Firm*—Donald H. Fidler

[57] ABSTRACT

A process for determining suitable parameters of temperature and/or pressure to use in a cementing operation in a wellbore to obtain a positive seal of cement in an annulus between a liner and a borehole wall after the cement has set up and where the process utilizes the parameters of differential temperature in a well bore, pressure on the cement to obtain a positive borehole wall stress (and positive seal) in a cementing operation.

11 Claims, 4 Drawing Sheets

CEMENTING SYSTEMS FOR OIL WELLS

FIELD OF THE INVENTION

This invention relates to a method for designing a cementing program and for cementing a liner pipe in a wellbore and obtaining a desired sealing force of the cement with the wellbore in situations where liquid circulation in the wellbore disturbs normal in-situ temperatures along the wellbore as a function of depth and where the disturbed temperatures are offset or different relative to a normal in-situ temperature profile of the wellbore as a function of depth when the wellbore is in a quiescent undisturbed state.

In particular, by use of data of the environmental elements as taken in a radial plane to a borehole axis, a desired positive sealing force upon curing of a column of wellbore annulus cement can be obtained in the cementing process so that the cured cement will also have a positive seal with respect to pore pressure when the cement sets up and the environmental elements of the wellbore return to a quiescent or undisturbed in-situ temperature state or to the ambient temperature state existent because of operations in the well such as acidizing, fracturing, steam injection or production from other intervals in the wellbore.

BACKGROUND OF THE INVENTION

In drilling a borehole or wellbore, the borehole can have the same general diameter from the ground surface to total depth (TD). However, most boreholes have an upper section with a relatively large diameter extending from the earth's surface to a first depth point. After the upper section is drilled a tubular steel pipe is located in the upper section. The annulus between the steel pipe and the upper section of the borehole is filled with a liquid cement slurry which subsequently sets or hardens in the annulus and supports the liner in place in the borehole.

After the cementing operation is completed, any cement left in the pipe is usually drilled out. The first steel pipe extending from the earth's surface through the upper section is called "surface casing". Thereafter, another section or depth of borehole with a smaller diameter is drilled to the next desired depth and a steel pipe located in the drilled section of borehole. While the steel pipe can extend from the earth's surface to the total depth (TD) of the borehole, it is also common to hang the upper end of a steel pipe by means of a liner hanger in the lower end of the next above steel pipe. The second and additional lengths of pipe in a borehole are sometimes referred to as "liners".

After hanging a liner in a drilled section of borehole, the liner is cemented in the borehole, i.e. the annulus between the liner and the borehole is filled with liquid cement which thereafter hardens to support the liner and provide a seal with respect to the liner and also with respect to the borehole. Liners are installed in successive drilled depth intervals of a wellbore, each with smaller diameters, and each cemented in place. In most instances where a liner is suspended in a wellbore, there are sections of the casing and of the liner and of adjacent liner sections which are coextensive with another. Figuratively speaking, a wellbore has telescopically arranged tubular members (liners), each cemented in place in the borehole. Between the lower end of an upper liner and the upper end of a lower liner there is an overlapping of the adjacent ends of the upper and lower liners and cement is located in the overlapped sections.

After a liner has been located through an earth strata of interest for production, the well is completed. The earth strata is permeable and contains hydrocarbons under a pore pressure.

In the completion of a well using a compression type production packer, typically a production tubing with the attached packer is lowered into the wellbore and disposed or located in a liner just above the formations containing hydrocarbons. The production packer has an elastomer packer element which is axially compressed to expand radially and seal off the cross-section of the wellbore by virtue of the compressive forces in the packer element. Next, a perforating device is positioned in the liner below the packer at the strata of interest. The perforating device is used to develop perforations through the liner which extend into cemented annulus between the liner and into the earth formations. Thereafter, hydrocarbons from the formations are produced into the wellbore through the perforations and through the production tubing to the earth's surface.

In the production of liquid hydrocarbons, gas is also produced during the life of a production well, gas migration or leakage in the wellbore is a particularly significant problem which can occur where gas migrates along the interfaces of the cement with a liner and a borehole. Any downhole gas leak outside the production system is undesirable and can require a remedial operation to prevent the leak from causing problems to other strata. Downhole gas leaks are commonly due to the presence of a micro-annulus between the cement annulus and the borehole wall and are difficult to prevent. There are also liquid leaks which can be equally troublesome. There are a number of prior art solutions proposed to obtain a tight seal of the cement column with the formation. Heretofore, however, none of these solutions have taken into account the borehole stress and the effect of downhole temperatures changes which occur during the cementing process.

The net effect of a considerable number of wellbore completion and remedial operations where liquids are circulated in the wellbore is to temporarily change the temperatures along the wellbore from its normal in-situ temperature conditions along the wellbore. The in-situ temperature conditions refer to the ambient downhole temperature which is the normal undisturbed temperature. However, the ambient downhole temperature can be higher than in-situ temperatures due to conditions such as steam flooding or production from other zones.

At any given level in a wellbore, the temperature change may be an increase or decrease of the temperature condition relative to the normal in-situ or ambient temperature depending upon the operations conducted.

In a co-pending application Ser. No. 865,188 filed Apr. 9, 1992, and entitled "Borehole Stressed Packer Inflation System", a system is described for use with inflatable packers where temperature effects are considered relative to obtaining a positive seal with an elastomer element in an inflatable packer.

In this application, the system is concerned with obtaining a cement seal of a column of cement between a liner and a borehole wall by taking into account the effect of downhole temperature effects. Downhole temperature effects can be caused by a number of factors, including acidizing, fracturing, steam injection or production from other intervals in a wellbore.

In primary cementing of a liner in a wellbore, heretofore, there also has been no consideration of the resultant final contact sealing force of the cement with the borehole wall after the wellbore resumes its ambient condition. Primary cementing is a complex art and science in which the operator utilizes a cementing composition which is formulated by taking into account the borehole parameters and drilling conditions. The objective of the cementing process is to fill the annulus between the liner and the borehole along the length of the liner with the cement bonding to or sealing with respect to the outer surface of the pipe and with respect to the borehole wall. A cured cement is intended to serve the purpose of supporting the weight of the pipe (anchoring the pipe to the wellbore) and for preventing fluid migration along the pipe or along the borehole wall and to provide structural support for weak or unconsolidated formations. Fluid migration is prevented if bonding of or sealing of the cement occurs with the pipe and with the borehole wall. One of the reasons that cement bonding fails to occur is because of the volumetric contraction of the cement upon setting. Despite all efforts to prevent contraction and efforts to cause expansion, cement tends to separate from a contacting surface. The separation in part can be related to the temperature effects in the borehole as will be discussed hereafter. Another factor in cement bonding is that the wellbore is drilled with a control fluid such as "mud" where a well surface filter cake is formed on permeable sections of the wellbore (to prevent filtrate invasion to the formations). The filter cake is, of course, wet and difficult to bond to cement.

The problem of bonding in primary cementing does not arise in many instances simply because the downhole formation pore pressures of the fluids do not exceed the inherent sealing characteristics of the cement column in place. This is particularly true in situations where a long impermeable interval is located above the production zone. However, where permeable zones are relatively close to one another and/or when pressure treating operations are conducted and/or gas is produced, leakage along the cement interface is more likely to occur.

SUMMARY OF THE PRESENT INVENTION

In the present invention, it is recognized that the temperature effects in a wellbore disturbed by drilling or other fluid transfer mechanisms and the strain resulting from borehole stress can be utilized in improving the downhole sealing efficiency of a cemented annulus between a pipe and a wellbore when the borehole temperatures reconvert to an in-situ undisturbed temperature condition or to ambient temperature conditions of the well.

In the present invention, a temperature profile of the wellbore is determined for an undisturbed in-situ or ambient state and for the disturbed state prior to cementing. Then at the desired depth location for the establishing a positive sealing force of the cement and in a radial plane, the temperature difference between the disturbed state and undisturbed state of each layer is determined where each layer refers to the pipe, the cement slurry, the wellbore and any other casings or annular elements which may be present.

Next, a sealing force for the cement slurry is selected and utilized with the temperature differences between disturbed borehole temperatures and undisturbed (or ambient) borehole temperatures in equations for the elastic strain and radial displacement for each of the layers using known borehole and drilling parameters to ascertain and to obtain a positive contact stress value of the cement with the wall of the borehole after the cement sets up and the borehole returns to undisturbed in-situ temperatures or to ambient temperature conditions of the well.

Alternatively, a desired contact stress value of set up cement in a borehole annulus can be selected and utilized with the temperature difference between disturbed borehole temperatures and undisturbed or ambient borehole temperatures in the equations for elastic strain and radial displacement for each of the layers using known borehole and drilling parameters to ascertain the pressure necessary on the cement slurry driving the cementing operation to obtain the desired final contact stresses.

Alternately, for a desired final contact stress of a cement column with a borehole wall and for a selected cement contact force, it can be determined what temperature differential is required during the cementing operation to obtain the desired final contact stress. Then the temperature of the system can be adjusted during the cementing operation to produce the necessary differences to obtain the desired result.

A general form of the strain equation for radial displacement of a layer element is $$\mu(R) = \frac{A}{R}\int_{R_1}^{R_0} \Delta TRdR + \frac{C_1}{R} + \frac{C_2}{R}$$

and for radial stress (or pressure) is $$\sigma(R) = \frac{X}{R_2}\int_{R_0}^{R_1} \Delta TRdR + YC_1 - \frac{Z}{C_2}$$

where the symbols A, X, Y and Z are established parameter values for the materials of the layer, R is a radius value, $\Delta T$ is the temperature difference between the disturbed state and the undisturbed state at the location for the layer in question.

In its simplest form, a wellbore cementing system is comprised of a liner (tubular steel pipe), a cement slurry layer (which sets up) and the earth or rock formation defining the wellbore. The rock formation is considered to have an infinite layer thickness.

The layers are at successively greater radial distances from the centerline of the borehole in a radial plane and have wall thicknesses defined between inner and outer radii from the center line.

Because completion operations in the wellbore alter temperatures along the length of the wellbore, the temperatures of various layers located below a given depth in the wellbore will be below the normal temperatures of the various layers after the wellbore returns to an undisturbed temperature. Above the given depth in the wellbore, the temperatures of the various layers will be higher than the normal temperatures after the wellbore returns to an undisturbed temperature. The "given" depth is sometimes referred to herein as the crossover depth. The temperature of the liquid cement slurry is usually introduced at a lower temperature than the temperature of the rock formation and also is usually at a lower temperature than any mud or control liquid in the wellbore.

After a cement slurry is pumped into the section to be cemented, a pre-determined pressure is applied to the cement slurry in the annulus to induce a certain strain energy in each of the more or less concentrically radially spaced layers of steel, cement, and rock. Strain energy is basically defined as the mechanical energy stored up in stressed material. Stress within the elastic limit is implied; therefore, the strain energy is equal to the work done by the external forces in producing the stress and is recoverable. Stated more generally, strain energy is the applied force and displacement including change in radial thickness of the layers of the system under the applied pressure.

The solid layer of cement after curing has a reduced wall thickness compared to the wall thickness of the liquid cement slurry because of the volumetric contraction of the cement when it sets up. This results in a condition where the cured cement layer loses some of its strain energy which decreases the overall strain energy of the system and reduces the contact sealing force of the cement with the borehole wall. In time, the wellbore temperature will increase (or decrease) to the in-situ undisturbed temperature or the operational or ambient temperature which will principally increase (or decrease) the strain energy in the cement and the pipe which reestablishes an increased (or decreased) overall strain energy of the system.

The purpose of the invention is to determine the contact sealing forces, giving effect to the change in temperatures and the cement contraction, as a function of pressure applied to the cement.

In practice then, in the present invention the contact stress on the borehole wall by the cement can be predetermined. The pressure applied to the cement and temperature changes can be optimized to obtain predicted contact stress in a wellbore as a function of pressure on the cement and the desired result can be predetermined.

DESCRIPTION OF THE PRESENT INVENTION

Figure 1:
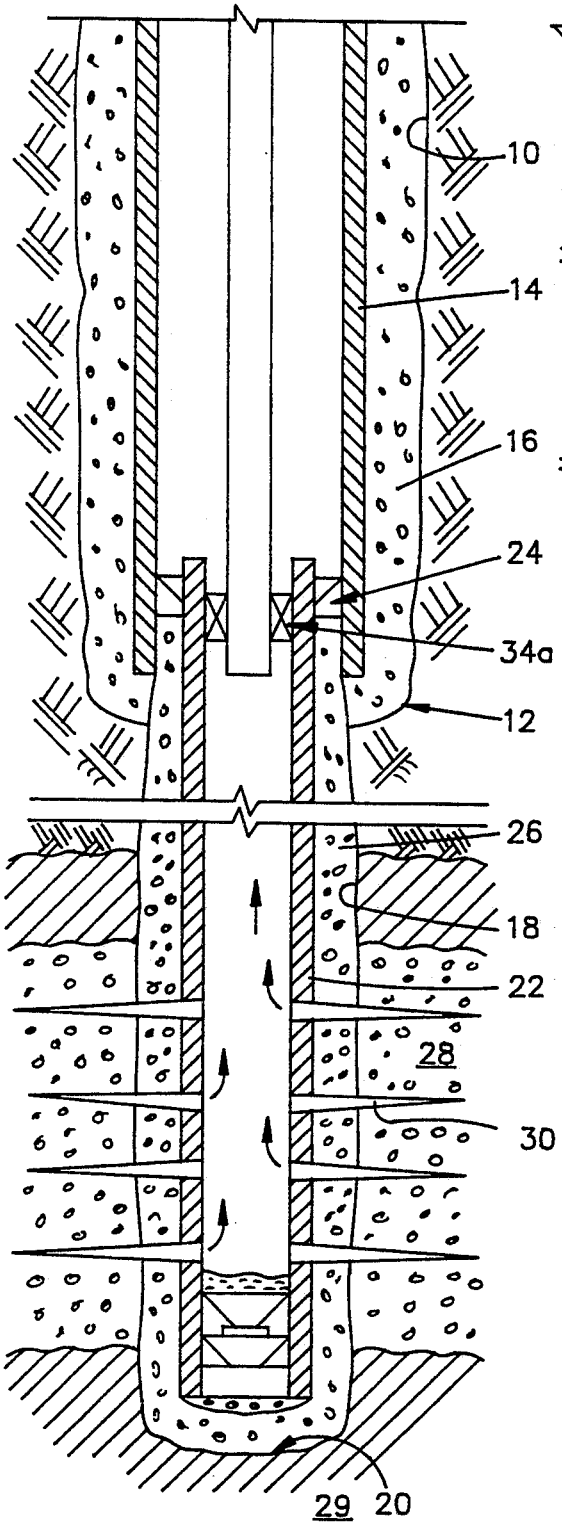
FIG. 1 is a vertical sectional view of a wellbore to illustrate a suitable production arrangement.

Referring now to FIG. 1, a representative wellbore is schematically illustrated with a borehole 10 extending from a ground surface to a first depth point 12 and with a tubular metal liner or casing 14 cemented in place by an annulus of cement 16. An adjacent borehole section 18 extends from the first depth point 14 to a lower depth point 20. A tubular metal liner 22 is hung by a conventional liner hanger 24 in the lower end of the casing 16 and is cemented in place with an annulus of cement 26.

The liner 22 is shown after cementing and as traversing earth formations 27,28, & 29 where the formation 28 is a permeable hydrocarbon filled formation located between impermeable earth strata 27 & 29. Perforations 30 place the earth formations 28 in fluid communication with the bore of the liner 22. Above the perforations 30 is a production packer 34*a* which provides a fluid communication path to the earth's surface. The formation 28 has a pore pressure of contained hydrocarbons which causes the hydrocarbon fluids to flow into the bore of the liner and be transferred to the earth's surface. The downhole pressure of the hydrocarbon fluids which can often include gas under pressure acts on the interfaces between the cement and the borehole wall. If the pipe/cement interface leaks then fluids can escape to the liner above causing a pressure buildup in this liner. This can be an unacceptable hazard. Similarly, if the cement-/formation interfaces leaks, fluids can escape to other formations. It can be seen that obtaining a seal of the cement interfaces is important.

Before a liner is installed and during the drilling of the borehole, mud or other control liquids are circulated in the borehole which change the in-situ undisturbed temperatures along the length of the borehole as a function of time and circulation rate. When the liner is installed, the mud or control liquids are also circulated. The control liquids provide a hydrostatic pressure in the wellbore which exceeds the pore pressure by the amount necessary to prevent production in the wellbore yet insufficient to cause formation damage by excessive infiltration into the earth formations. The wall surface of the wellbore which extends through a permeable formation generally has a wet filter cake layer developed by fluid loss to the formation.

The well process as described with respect to FIG. 1 is typically preplanned for a well in any given oil field by utilizing available data of temperature, downhole pressures and other parameters. The planning includes the entire drilling program, liner placements and cementing programs. It will be appreciated that the present invention has particular utility in such planning programs.

Figure 2:
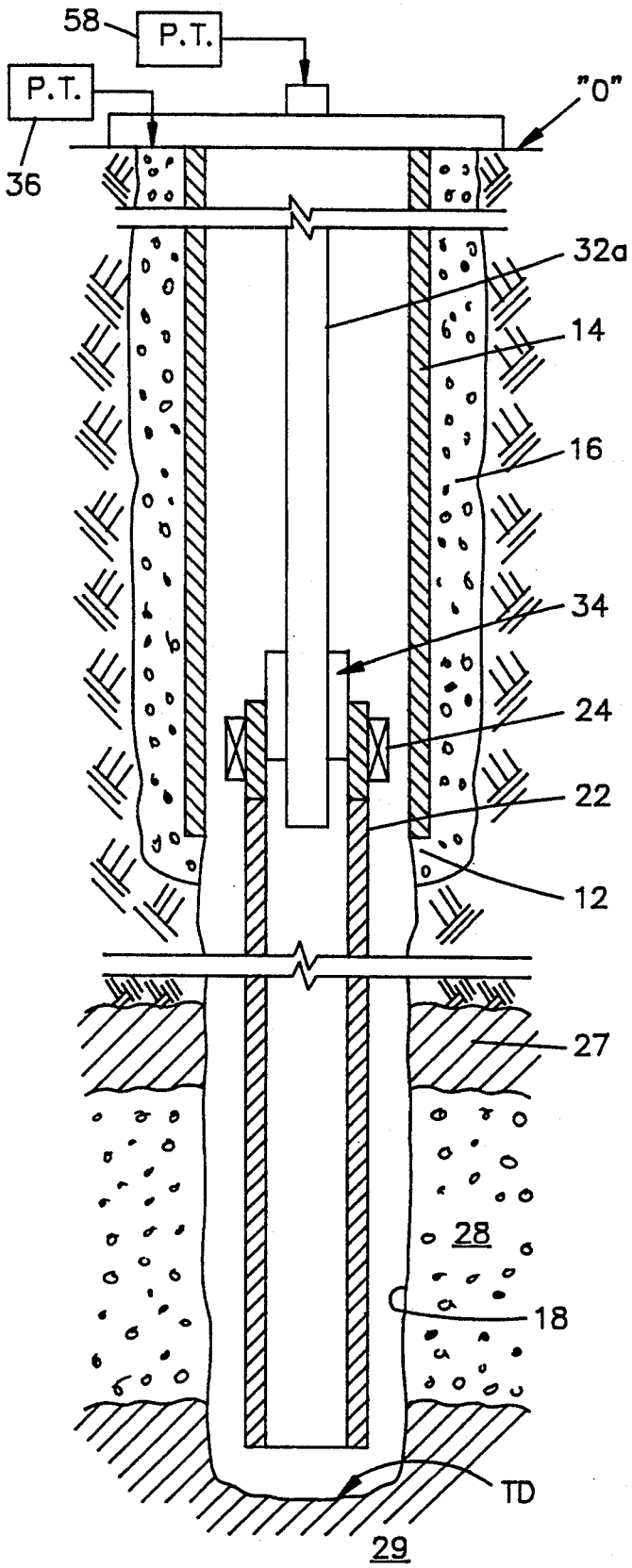
FIG. 2 is a vertical sectional view of a wellbore to illustrate a liner and a liner hanger suspended from a tubing string and setting tool in the wellbore.
Figure 3:
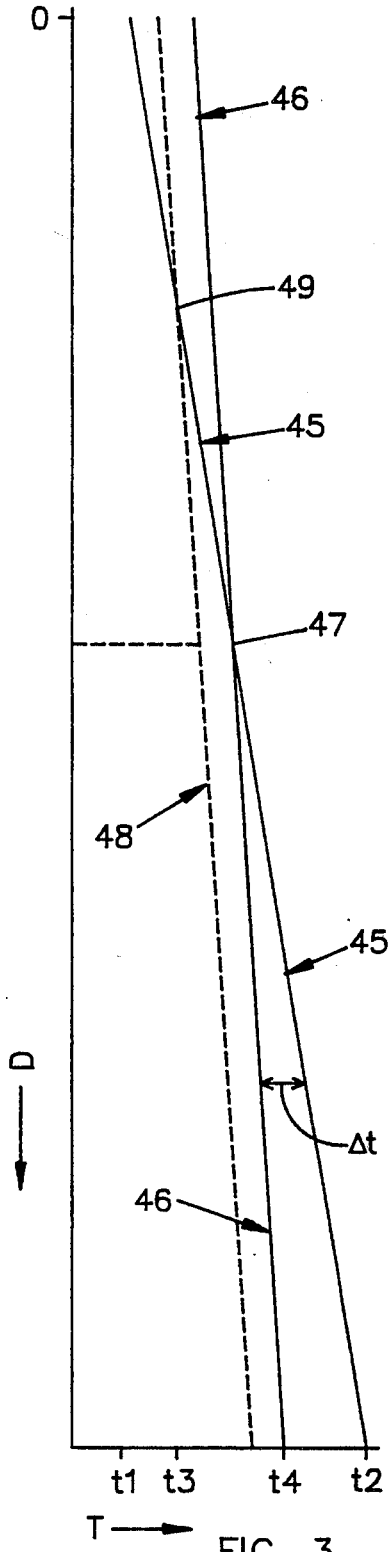
FIG. 3 is a graphical plot of borehole temperature versus depth.

Referring now to FIGS. 2 & 3, where the wellbore traverses earth formations from the earth's surface (ground zero "0" depth) to a total depth (TD), the earth formations 27,28,29, the liner 22 and the cement 16 in the borehole in an ambient state prior to well bore operations will have a more or less uniform temperature gradient 45 from an ambient temperature value $t_1$, at "0" depth (ground surface) to an elevated or higher temperature value $t_2$ at a total depth TD. The ambient temperature state can be the operating temperature for steam flood or other operations or can be a quiescent undisturbed state. A quiescent undisturbed state is herein defined as that state where the wellbore temperature gradient is at a normal in-situ temperature undisturbed by any operations in the wellbore and is the most common state.

Liquids which are circulated in the wellbore during drilling, cementing and other operations can and do cause a temperature disturbance or temperature change along the wellbore where the in-situ undisturbed or ambient temperature values are changed by the circulation of the liquids which cause a heat transfer to or from the earth formations. For example, in FIG. 2, a string of tubing 32*a* supports a setting tool 34 which is releasably attached to a liner hanger 24 and liner 22. A circulating liquid in the well from either a surface located pump tank 36 or 38 changes the temperature values along the length of the wellbore as a function of depth, the time and circulation rate so that a more or less uniform disturbed temperature gradient 46 is produced which has a higher temperature value $t_3$ than the temperature value $t_1$ at "0" depth and a lower temperature value $t_4$ than the in-situ undisturbed or ambient temperature value $t_2$ at the depth TD. The plot of the disturbed temperature gradient 46 will intersect the plot of the undisturbed temperature gradient 45 at some crossover depth point 47 in the wellbore. Below the crossover temperature depth point 47, the wellbore will generally be at a lower temperature than it would normally be in its quiescent undisturbed or ambient state. Above the cross-over temperature depth point 47, the wellbore will generally be at a higher temperature than it would normally be in its quiescent undisturbed or ambient state. It will be appreciated that a number of factors are involved in the temperature change and that, in some operations, the downhole TD temperature can approach ambient surface temperature because of the heat transfer mechanism of the circulating liquids and the temperature of the liquids used in the operation.

In the illustration shown in FIGS. 2 & 3, the cross-over point 47 is located approximately mid-way of an overlap between the liner 22 and the casing 14. As a result the temperature change above the cross-over point 47 will decrease upon returning to in-situ temperature and may cause a bad seal to occur in the overlapped portions of the liner and the casing. This situation can be corrected in the initial pre-planning stage by lowering the bottom 12 of the casing to a location below the cross-over point 47 so that the over-lapped portions have a sufficient temperature differential ($\Delta T$) to obtain an adequate seal. The crossover point depends on the temperature at TD($t_2$). It might be impractical to determine the setting point by temperature profile alone. The casing point is usually determined by expected pressure gradient changes (either higher or lower). But the norm is an increase in pressure gradient and temperature gradient will probably increase (sometimes sharply). Alternately the drilling program can be altered by circulating a liquid at a low temperature for a sufficient time to develop a lower temperature profile 48 with a higher cross-over point 49 and a greater temperature differential at the overlapped portions of the casing and the liner.

Figure 4:
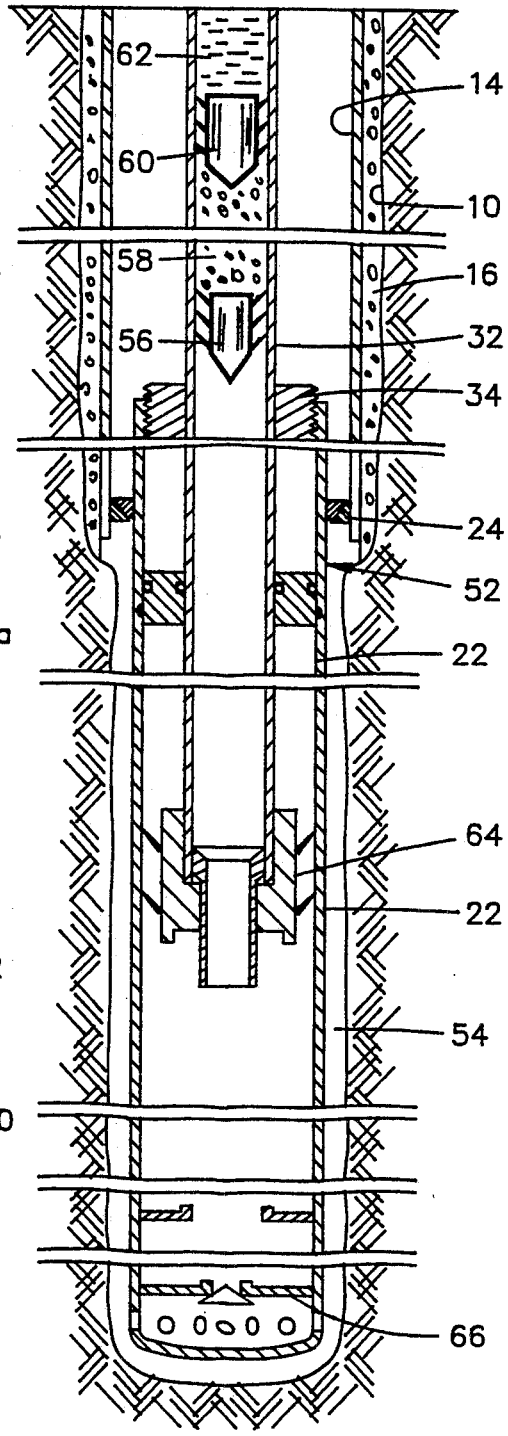
FIG. 4 is a vertical sectional view of a wellbore to illustrate a cement operation.

Referring to FIG. 4, in a typical cementing operation for installing a liner 22 in a borehole 18 which contains a control liquid or mud, a liner 22 is releasably attached by a setting tool 34 to a liner hanger 24 located at the upper end of the liner 22. The liner 22 is lowered into the wellbore on a string of tubing 32. When the liner is properly located, control liquids or mud are circulated from the string of tubing to the bottom of the liner and return to the earth surface by way of the annulus 54. In a typical operation, the operator has calculated the volume of cement necessary to fill the volume of the annulus 54 about the liner in the borehole up through the overlapped portions of the liner and the casing. To cement the liner in place, the setting tool 24 is released from the liner and a cement slurry 58 is pumped under pressure. When the calculated volume of cement has been pumped, a trailing cement plug 60 is inserted in the string of tubing and drilling fluid or mud 62 is then used to move the cement slurry. When the trailing plug 60 ultimately reaches the wiper plug 64 on the liner hanger, it latches into the wiper plug and the liner wiper plug 64 is released by pump pressure so that the cement slurry is followed by the wiper plug 64. The cement slurry 58 exits through the float valve and cementing valve 66 at the bottom end of the liner and is forced upwardly in the annulus 54 about the liner 22 mud or control liquid in the annulus exits to a surface tank. During this cementing operation, the operator sometimes rotates and reciprocates the liner 22 to enhance the dispersion of the flow of cement slurry in the annulus 54 to remove voids in the cement and the object is to entirely fill the annulus volume with cement slurry. When the calculated volume of cement is in the annulus 54, the float valve 66 at the lower end of the liner prevents reverse flow of the cement slurry. The pump pressure on the wiper plug to move the cement slurry can then be released so that the pressure in the interior of the liner returns to a hydrostatic pressure of the control liquid.

Cement compositions for oil well cementing are classified by the American Petroleum Institute into several classifications. In the preplanning stage the cement can be modified in a well known manner by accelerators and retarders relative to the downhole pressure, temperature conditions and borehole conditions. Cement additives typically are used to modify the thickening time, density, friction during pumping, lost circulation properties and filtrate loss.

Figure 5:
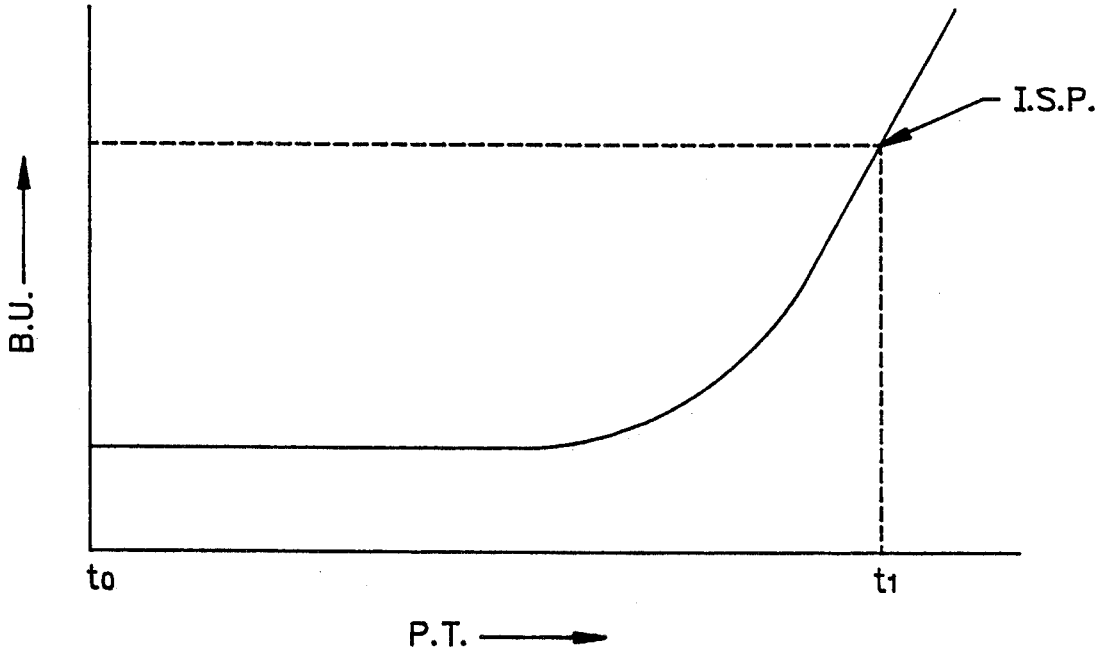
FIG. 5 is a plot of the function of cement hydration as a function of conventional Beardon units.

When water is added to the cement to make the slurry pumpable and provide for hydration (the chemical reaction) a "pumping time" period commences. The pumping time period continues until the "initial set" of the cement at its desired location in the annulus. The pumping time can be calculated in a well known manner and includes the "thickening time" of cement which is a function of temperature and pressure conditions. The "thickening time" is the time required to reach the approximate upper limit of pumpable consistency. Thus, the thickening time must be sufficient to ensure displacement of the cement slurry to the zone of interest. When the pumping of cement stops, the cement begins to develop an "initial set" consistency at an initial set point. The "initial set" point may best be understood by reference to FIG. 5. In FIG. 5, a plot of cement characteristics as a function of pump time and Beardon Units (which is conventional) illustrates the time relationship between the initial start of pumping at a time $t_0$ and a time $t_1$ where the initial set occurs. At the initial set point time, pressure applied to the cement is effectively acting on a solid cement column.

The plot of the pump time from a time $t_0$ to a time $t_1$ is a conventional determination made for each particular cement in question an initial set point is generally accepted to be equal to seventy (70) Beardon Units.

In short, the cement slurry for the present invention must have the characteristics of pumpability to the zone of interest (adequate thickening time); density related to the formations characteristics to decrease the likelihood of breaking down the formation and a low static gel strength so that when the cement is in place, pressure can be applied to the cement until initial set of the cement occurs. "Pump time" as used herein is the time between the initial formulation of the cement at the earth's surface and its initial set in the wellbore. Thus, the pumping time should not be excessively long so that annulus pressure can be applied to the cement after pumping stops and before initial set of the cement occurs to pressure up the cement column to a selected pressure. After the cement set point, in a conventional manner, there is a time wait for curing and any unnecessary cement in the liner is removed by a drilling operation. Next, a production packer is installed on a string of tubing and the formation of interest is perforated to produce hydrocarbons (See FIG. 1).

When the cement slurry is pumped down the liner and upwardly through the annulus, strain energy is developed in the liner, and in the surrounding rock formation. The pressure on the inside and outside walls of the liner is nearly equal until the cement is in place and the pumping pressure reduced to hydrostatic. At this time, the pressure in the annulus is generally higher than the pressure in the bore of the liner.

The cement is typically a fluid which begins to gel as soon as the pumping stops. At some point in the gelation process the initial set point is reached where strain energy due to pressure on the cement becomes fixed. The volume of the cement contracts in setting after the set point is reached due to chemical reaction and free water loss to formations and the strain energy in the cement will decrease. This results in a change of overall strain energy in the system of the liner, the cement and the formations.

In time, however, the strain energy in the system will again change because the temperature in the liner, the set cement and the rock formation will increase (or decrease) to the in-situ undisturbed or ambient temperature at the depth location of the cement in the wellbore. The change in temperature in all of these elements causes a change in the radial dimensions (thickness) which increases (or decreases) the strain energy in the system. The strain energy increases when the cement is located below the crossover temperature depth point illustrated in FIG. 3 and decreases when the cement is located above the crossover temperature depth point.

In either case, if the cement lacks the desired final strain energy (is not sufficiently in contact with the annular walls) after all of the elements at the location return to an undisturbed or ambient temperature, the contraction and dimensional changes of the cement, the liner and the rock formation can produce an annular gap between the cement and the borehole wall and lack sufficient pressure to maintain a seal or positive sealing pressure.

In the present invention a predetermined pressure can be applied to the cement slurry during the cementing process to obtain a desired positive contact stress force after the cement has cured. With a positive contact stress, a gap or a loss of seal with the borehole wall pressure to permit a leak does not occur and a sufficient desired positive contact pressure remains between the cement and the borehole wall to maintain a seal without borehole fluid leakage even after the elements in the borehole return to their undisturbed or operational temperature values.

In practicing the present invention, a first step is to obtain the quiescent or in-situ undisturbed or ambient temperature in the wellbore as a function of depth. This can be done with a conventional temperature sensor or probe which can sense temperature along the wellbore as a function of depth. This temperature data as a function of depth can be plotted or recorded. Alternatively, a program such as "WT-DRILL" (available from Enertech Engineering & Research Co., Houston, Tex.) can be used at the time the well completion is in progress. It will be appreciated that in any given oil field there are historical data available such as downhole pressures, in-situ temperature gradients formation characteristics and so forth. A well drilling, cementing and completion program is preplanned.

In the preplanning stage, the WT-DRILL program, well data is input for a number of parameters for various well operations and procedures. Data input includes the total depth of the wellbore, the various bore sizes of the surface bore, the intermediate bores, and the production bores. The outside diameters (OD), inside diameters (ID), weight (WT) of suspended liners in pounds/foot and the depth at the base of each liner is input data. If the other well characteristic are involved, the data can include, for deviated wells, the kick off depth or depths and total well depth. For offshore wells, the data can include the mudline depth, the air gap, the OD of the riser pipe, and the temperature of the seawater above the mudline, riser insulation thickness and K values (btu/hr-Ft-F). Input of well geometry data can include ambient surface temperature and static total depth temperature. In addition, undisturbed temperature at given depths can be obtained from prior well logs and used as a data input. The Mud Pit Geometry in terms of the number of tanks, volume data and mud stirrer power can also be utilized. The mud pit data can be used to calculate mud inlet temperature and heat added by mud stirrers can be related to the horsepower size of the stirrers.

In an ongoing drilling operation, drilling information of the number of days to drill the last section, the total rotating hours, start depth, ending depth and mud circulation rate are input data. The drill string data of the bit size, bit type, nozzle sizes or flow area, the OD, ID and length of drill pipe (DP), the DP and collars are input data. The mud properties of density, plastic viscosity and yield point are input data.

If data is available, Post Drilling Operations including data of logging time, circulation time before logging, trip time for running into the hole, circulation rate, circulation time, circulation depth, trip time to pull out of the hole may be used.

Cementing data includes pipe run time, circulation time, circulation rate, slurry pump rate, slurry inlet temperature, displacement pump rate and wait on cement time. Also included are cement properties such as density, viscometer readings and test temperature. Further included are lead spacer specification of volume, circulation rate, inlet temperature, density, plastic viscosity and yield point.

Thermal properties of cement and rock such as density, heat capacity and conductivity are input. The time of travel of a drill pipe or a logging tool are data inputs.

All of the forgoing parameters for obtaining a temperature profile are described in "A Guide For Using WT-Drill", (1990) and the program is available from Enertech Computing Corp., Houston, Tex.

In the present invention, a factor for bulk contraction (shrinkage) is an input.

In the present invention, the disturbed temperature as a function of depth can be determined from the WT-Drill Program just prior to cementing a liner. In this regard, the temperature location depth can be the midpoint of the cemented interval length, the top and bottom of the cemented interval or a combination of depth locations. For each location (top, middle or bottom), a determination is made of the temperature and pressure to obtain a desired positive contact stress.

As discussed above, the discrete volume of cement slurry is then injected by pumping pressure to the selected interval of the annulus between a liner and a wellbore. When the pumping pressure is relieved, the cement on the annulus is subjected to a setting pressure to obtain a desired positive contact stress between the cement slurry and the wall of the wellbore before the initial set of the cement. A successful sealing application of the cement in a wellbore depends upon the contact stress remaining after the initial set and subsequent cement contraction and after temperature changes occur when the wellbore returns to its quiescent undisturbed or ambient state.

In order to predict with some certainty the final wellbore contact stress, thermal profile data of the wellbore with data values for an initial cement slurry in place are utilized with a selected pressure value on the cement slurry in a radial plane strain determination to obtain a value for the contact stress after the cement sets up and the wellbore returns to an undisturbed state or ambient condition. In some instances it will be determined that the cement cannot obtain the desired results thus predetermining that a failure will occur. When the contact stress as thus determined is insufficient or inadequate for effecting a seal, then other procedures for obtaining a seal such as applying pressure through a valve in the casing U.S. Pat. No. 4,655,286 or using an inflatable packer can be utilized. In all instances the stresses are established for future reference values.

The residual contact stress is determined by a stress analysis of the liner, the cement, and the formation. The stress analysis is based on the radial strains in the layered components of the system as taken in a radial plane where the radial strains are fairly symmetric about the central axis of the liner. In elastic strain analysis a plane strain axi-symmetric solution of static equilibrium equations with respect to temperature changes for a given layered component in a system is stated as follows:

$$u(R_o) = \frac{(1+\nu)}{(1-\nu)}\, a \frac{1}{r} \int_{R_i}^{R_e} \Delta T(\xi)\xi d\xi + C_1 r_o + C_2/r^2 \quad (1)$$

$$\sigma_r(R_o) = -\frac{aE}{(1-\nu)} \frac{1}{r^2} \int_{R_i}^{R} \Delta T(\xi)\xi d\xi + \frac{\lambda}{\nu} C_1 - 2GC_2/r^2 \quad (2)$$

$$\sigma_\theta(R) = -\frac{aE}{(1-\nu)} \frac{1}{r^2} \int_{R_i}^{R} \Delta T(\xi)\xi d\xi \frac{aE\Delta T(r)}{(1-\nu)} + \frac{\lambda}{\nu} C_1 - 2GC_2/r^2 \quad (3)$$

$$\sigma_z(R) = \frac{aE\Delta T(r)}{(1-\nu)} + 2\lambda C_1 \quad (4)$$

where:

- r—radius (in)
- $r_i$—inside radius (in)
- u(r)—radial displacement (in)
- $\sigma_r(r)$—radial stress (psi)
- $\sigma_\theta(r)$—hoop stress (psi)
- $\sigma_z(r)$—axial stress (psi)
- E—Young's modulus (psi)
- $\nu$—Poisson's ratio
- G—Shear modulus, $2G-E/(1+\nu)$, (psi)
- $\lambda$—Lame's constant, $\lambda=2G\ \nu/(1-2\nu)$, (psi)
- a—coefficient of linear thermal expansion (1/F)
- $\Delta T$—temperature change (F) and is a function of r with respect to RdR
- $C_1$, $C_2$—constants determined by boundary conditions
- $\xi$—is a symbol for R for notational purposes
- R—any radius between $r_o$ and $r_i$ In one aspect of the invention, the hoop stress (Equation 3) and axial stress (Equation 4) are not considered significant factors in determining the sealing effects after the wellbore returns to its in-situ undisturbed conditions.

Figure 6:
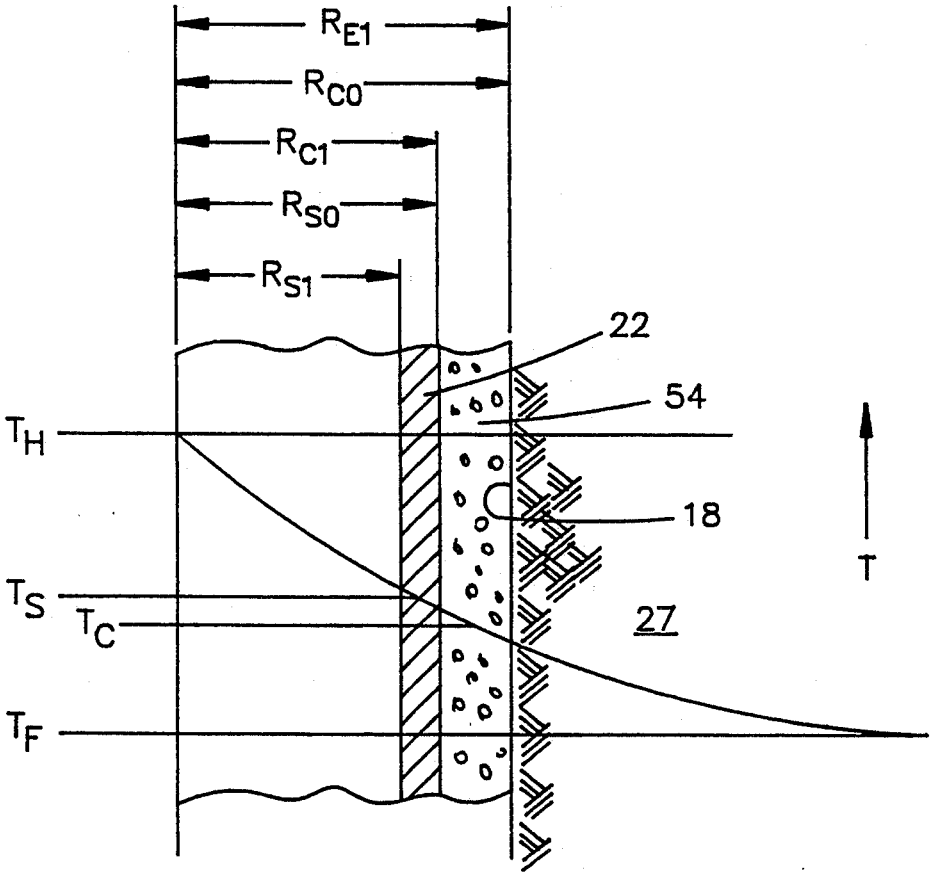
FIG. 6 is a partial view showing radial dimensions and thicknesses of the layer components from a center line.
Figure 7:
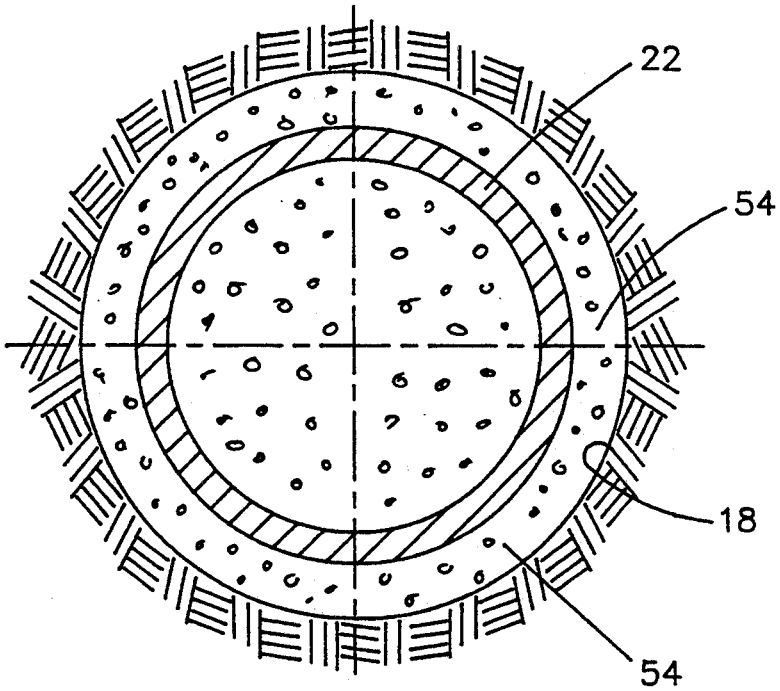
FIG. 7 is a cross section through a liner in a wellbore to illustrate a cement annulus in a wellbore.

Considering Equations (1) & (2) then for radial displacement and radial stress it can be seen that each layer at a given horizontal plane in a wellbore has two unknown coefficients $C_1$ and $C_2$. By way of reference and explanation, in FIGS. 6 & 7 involve a partial schematic diagram of a wellbore illustrating a center line CL and radially outwardly located layers of steel 22, cement 54, and earth formations 27. Overlaid on the FIG. 6 illustration is a temperature graph or plot illustrating increasing temperatures relative the vertical CL axis from a formation temperature $T_f$ to a wellbore temperature $T_H$. At a medial radial location in the steel liner 22, there is a temperature $T_S$ which is lower than the temperature $T_H$. A median radial location in the cement 54 has a temperature $T_C$ which is lower than the temperature $T_S$. At some radial distance into the formation, an undisturbed formation or ambient temperature $T_F$ exists. With a disturbed condition in the wellbore the temperature of the components defines a gradient from a location at the center of the wellbore to a location in the formation temperature $T_F$.

As the illustration in FIG. 6 shows, the various layers are defined between their radii as follows:

steel layer between $R_{SI}$ and $R_{SO}$ cement layer between $R_{CI}$ and $R_{CO}$ and where the following inside radii and outside radii are equal.

$R_{SO}=R_{CI}$ $R_{CO}=R_{EI}$

In FIG. 5, a single liner is illustrated however, the liner can also overlap an upper liner section providing additional layers and radii. The single liner solution is present for ease of illustration.

At the depth location as illustrated in FIG. 6, a temperature gradient occurs between a radius location in the formation where the temperature $T_F$ is at the undisturbed or ambient formation temperature and a center line location in the wellbore where the temperature $T_H$ is at the wellbore temperature. The shape of the gradient is largely a function of the properties of the formations and can be almost linear.

All of the parameters of Equations (1) & (2) are predetermined for each layer of the system so that the only unknowns for each layer are the coefficients $C_1$ and $C_2$. By definition, the coefficients $C_1$ and $C_2$ for the interface between the steel and cement are equal, the coefficients $C_1$ and $C_2$ for the interface between the cement and the borehole wall are equal. In other words, the stress at one edge of one layer wall is equal to the stress at the edge of an adjacent layer wall.

In the fundamental analysis then, there are two equations (1) and (2) for the steel layer and two equations (1) and (2) for the cement layer which total four equations and two unknown coefficients.

The equations can be solved by Gauss elimination or block tridiagonals. In the solution, a desired cementing pressure is selected and the associated contact sealing force is determined.

Material Properties

The solution of the above stress formula requires a determination of the elastic properties of several diverse materials in the layers. Steel properties do not vary greatly and are relatively easy to obtain:

| Common reported values are: | Values selected for use |
|---|---|
| Young's modulus: $E = 28\text{–}32 \times 10^6$ psi | $30 \times 10^6$ |
| Poisson's ratio: $v = 0.26\text{–}0.29$ | .29 |
| Thermal expansion: $a = 5.5\text{–}7.1 \times 10^{-6}$/F. | $6.9 \times 10^{-6}$ |

Rock or formation properties are considerably more varied and some properties are more difficult to find, such as the thermal expansion coefficients for different materials:

Values associated with representative formation materials include the following:

Limestone:

Young's modulus: $E=73\text{–}87\times 10^5$ psi

Poisson's ratio: $v=0.23\text{–}0.26$

Thermal expansion: $a=3.1\text{–}10.0\times 10^{-5}$/F

Sandstone:

Young's modulus: $E=15\text{–}30\times 10^5$ psi

Poisson's ratio: $v=0.16\text{–}0.19$

Thermal expansion: $a=3.1\text{–}7.4\times 10^{-6}$/F

| | Values selected for use: |
|---|---|
| Shale: | |
| Young's modulus: $E = 14\text{–}36 \times 10^5$ psi | $30 \times 105$ |
| Poisson's ratio: $v = 0.15\text{–}0.20$ | .18 |
| Thermal expansion: $a = 3.1\text{–}10.0 \times 10^{-6}$/F. | $3.1 \times 10^{-6}$ |

Cement properties vary with composition. The following values for cement are considered nominal:

| | Values selected for use: |
|---|---|
| Young's modulus: $E = 10\text{–}20 \times 10^5$ psi | $15 \times 10^5$ |
| Poisson's ratio: $v = 0.15\text{–}0.20$ | .20 |
| Thermal expansion: $a = 6.0\text{–}11.0 \times 10^{-6}$/F. | $6.0 \times 10^{-6}$ |

The volume change of the cement layer due to cement hydration and curing is needed for the analysis, and is one of the critical factors in determining the residual contact stress between the packer and the formation. A study by Chenevert [entitled "Shrinkage Properties of Cement" SPE 16654, SPE 62nd Annual Technical Conference and Exhibition, Dallas, Tex. (1987)] indicates a wide variation in cement contraction because of different water and inert solids content. It appears that a contraction of about 1% or 2% is the minimum that can be achieved. Cement producing this minimum contraction can be used in the practice of this invention for optimum results. In any event, with the cement parameters, the thickness of the cement annulus after curing can be predetermined.

EXAMPLE OF ESTIMATED CONTACT STRESSES GENERATED CEMENTING OPERATION

The formation contact stresses for a certain well was determined using the following assumptions:

Cement Contraction=1%

The following example for practicing the invention is in a well based on a well depth of 11,500 ft., and bottom hole pore pressures of 5380 psi. A final contact stress of 100 psi was desired. At this point then, a selection of cementing pressure was made. The value of 1800 psi (above pore pressure) was used as a selected pressure increment. At the depth where cementing is intended, the temperature differential relative to undisturbed temperature in a radial plane (below the temperature crossover depth point) is as follows.

| RADIUS (IN) | TEMPERATURE (F.) |
|---|---|
| 2.32 | 38.10 |
| 2.69 | 38.90 |
| 3.81 | 31.80 |
| 5.01 | 24.51 |
| 6.21 | 19.36 |
| 7.41 | 15.69 |
| 8.60 | 13.06 |
| 9.80 | 11.11 |
| 11.00 | 9.65 |
| 13.00 | 8.39 |
| 27.97 | 1.49 |
| 60.20 | 0.04 |
| 129.56 | 0.00 |
| 278.81 | 0.00 |
| 600.00 | 0.00 |

The following are the layer characteristics utilized for the liner, the cement, and the earth formation (rock) at the cementing location:

| | | | WELL #1 8½" I.D. | | |
|---|---|---|---|---|---|
| LAYER | INSIDE DIA (IN) | OUTSIDE DIA (IN) | YOUNGS MODULUS (PSI) | POISSONS RATIO | COEF LIN THERM EXPNSN (1/F.) |
| Liner | 4.29 | 5.00 | 30.00E + 6 | .290 | 6.900E − 6 |
| Cement | 5.00 | 6.50 | 15.00E + 5 | .200 | 6.000E − 6 |
| Rock | 4.25 | * | 30.00E + 5 | .180 | 3.000E − 7 |

(*equals the radius at which the formation temperature remains undisturbed.)

Utilizing Equations (1) & (2) above with the ΔT determinations and a cementing pressure of 1800 psi above pore pressure, gave the following stress results for the various layers while the cement is still liquid and prior to reaching its initial set:

| LAYER | INSIDE RADIUS (IN) | OUTSIDE RADIUS (IN) | (a) INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Liner | 2.14 | 2.50 | 1800. | 1800. | 7180. | 7180. |
| Cement | 2.50 | 3.25 | 1800. | 1800. | 7180. | 7180. |
| Rock | 3.25 | * | 1800. | 1800 | 7180. | * |

Next utilizing Equations (1) and (2) above with the $\Delta T$ determinations and assuming the condition when cementing pressure and the pressure in the string of tubing is adjusted to hydrostatic pressure, and using a cement volume change upon curing equal to $-0.0100$ ft3/ft3, the stress in the layers calculated at the time the packer cement has set up is:

| LAYER | INSIDE RADIUS (IN) | OUTSIDE RADIUS (IN) | (b) INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Liner | 2.14 | 2.50 | 0. | 951. | 2280. | 6331. |
| Cement | 2.50 | 3.25 | 951. | 100. | 6331. | 5480. |
| Rock | 3.25 | * | 100. | * | 5480. | * |

It can be seen that the contact stress of the cement is at 100 psi.

The above results show that a 100 psi contact stress can be achieved for the cementing process by correlating the in-situ temperature with the cementing pressure.

As discussed heretofore, there are two unknown boundary constants $C_1$ and $C_2$ for each layer of material. The stress analysis of the liner to formation assemblage (radial layers of materials) is determined by matching boundary conditions at the inside of the liner, at the interfaces between layer components and at the outside radius of the wellbore.

There are two load cases considered in the above analysis, (1) the pressure with a cement slurry prior to its initial set and (2) the contact stress with the wellbore after the cement sets. In the cement slurry case, the conditions used are:

1. the radial pressure at the outside radius of the liner is the cement slurry pressure;
2. the cement is considered a fluid at the cementing pressure, so the stress formulas are not used;
3. the displacement and radial stress at the outside radius of the cement match the displacement and radial stress at the inside radius of the wellbores; the displacement of the formation at infinity is zero;

Analysis of the case after the cement sets differs only in the treatment of the cement. In this case the cement is considered a solid, so that the following boundary conditions are used:

1. The displacement and radial stress at the outside radius of the liner match the displacement and radial stress at the inside radius of the cement.
2. The displacement and radial stress at the outside radius of the cement match the displacement and radial stress at the inside radius of the wellbore.

The set of boundary conditions forms a block tridiagonal set of equations with unknown constants $C_1$ and $C_2$ for each layer of material. The boundary conditions are solved using a conventional block tridiagonal algorithm.

After the cement sets, the temperature change is utilized to determine the contact stress when the wellbore returns to an undisturbed temperature condition or operating temperature.

In the above example, it is established that the selected contact pressure is a function of the ultimate contact stress. Thus, the analysis process can be used so that for a selected cement pressure, the ultimate contact stress can be determined before the cementing operation is conducted in a wellbore. Therefore, it is predetermined that the cement will obtain a sufficient contact stress after the well returns to an undisturbed condition.

Alternatively, a desired contact stress can be selected and the cementing pressure necessary to achieve the selected contact stress can be determined. This permits the operator to safely limit contact pressures by controlling the annulus pressure on the cement. This also predetermines if the cementing pressure is below the fracture pressure of the formation.

In still another alternative, the temperature differential can be altered by circulation with cold liquids to provide a desired or necessary temperature differential.

This is a solution based upon isotropic cement contraction in which the change in wall thickness is greater than actually encountered which provides a safety factor.

The effect of plane strain cement contraction can best be understood by consideration of the following examples:

It will be appreciated that the forgoing process can be refined to determine the axial, radial and hoop cement contraction strains on an independent basis so that any combination can be used.

In cement, the relationship for stresses and strains for general cement contraction is given by:

$$E(\epsilon_r+\delta_r)=\sigma_r-\gamma(\sigma_z+\sigma_\theta)$$

$$E(\epsilon_\theta+\delta_\theta)=\sigma_\theta-\gamma(\sigma_r+\sigma_z)$$

$$E(\epsilon_z+\delta_z)=\sigma_z-\gamma(\sigma_r+\sigma_\theta)$$

where:

$\epsilon_r$—strain in the radial direction
$\epsilon_\theta$—strain in the hoop direction
$\epsilon_z$—strain in the axial direction
$\delta_r$—cement volume decrease in the radial direction
$\delta_\theta$—cement volume decrease in the hoop direction
$\delta_z$—cement volume decrease in the hoop direction
$\sigma_r$—stress in the radial direction (psi)

$\sigma_\theta$—stress in the hoop direction (psi)
$\sigma_z$—stress in the axial direction (psi)
E—Young's modulus (psi)
$\gamma$—Poisson's ration where $\delta_r$ is the contraction in the r direction, $\delta_\theta$ is the contraction in the hoop direction, and $\delta_z$ is the contraction in the z direction. The total volume change is:

$$\Delta\gamma/\gamma = -\delta_r - \delta_\theta - \delta_z$$

The radial strain only case is then a special case of this general model ($\delta_\theta = \delta_z = 0$).

The cement contraction option may be used to allow the cement to contract only in the radial direction within the liner/wellbore annulus. The anticipated effect of this application is to decrease the radial compressive stress on the mandrel due to cement contraction. For example, if the cement is assumed to fail in the hoop direction, the hoop contraction should be set to zero.

The effect of cement contraction may be decreased due to axial movement of the cement during setting. In plane strain, the axial contraction affects the radial and hoop stresses through the Poisson effect. If axial movement is allowed (not plane strain), the axial contraction has no effect on the radial and hoop stresses. For this reason, the effect of the axial cement contraction is removed from the calculation.

In summary of the system, for a given oil field the existing downhole parameters are determined and the drilling, cementing and completion programs are designed. The WT-Drill Program is run to establish the relationship of disturbed temperature profile to the in-situ temperature profile. The temperature crossover point is established and adjustments are made to the liner depths or temperature requirements to obtain an optimum temperature differential for an optimum pressure on the cement.

The temperature data for a location in the selected interval in the wellbore to be isolated or sealed by the cement is input with a selected pressure to be applied to the cement before it reaches its set point. The contact stress is determined for the system prior to the initial set point of the cement. Next the contact stress is determined for the system after the set point for the cement is passed and the cement is set up. A positive contact stress is indication of a seal. A negative contact stress indicates a seal failure will occur. If a seal failure is indicated, the pressure and/or temperature differential can be changed to obtain a positive contact stress.

The pressure is applied by annulus pressure from the surface which includes the hydrostatic pressure of the cement. In some instances it may be possible to apply pressure across the cement, for example with use of stage valves. The downhole temperature differential can be changed by changing the temperature of circulatory liquids.

Alternatively, a final contact stress can be selected and the pressure and differential temperature requirements are then established to reach the final contact stress.

It will be apparent to those skilled in the art that various changes may be made in the invention without departing from the spirit and scope thereof and therefore the invention is not limited by that which is disclosed in the drawings and specifications but only as indicated in the appended claims.

We claim:

1. A method for cementing a liner in a wellbore to effect a positive contact stress seal of a cemented wellbore annulus with a borehole wall and the liner where the wellbore traverses earth formations and defines a wellbore annulus and where the wellbore has a disturbed temperature condition relative to a quiescent temperature condition which establishes a temperature differential as a function of depth and where said liner, said cemented annulus and earth formations are radial layers of elements extending radially from a borehole centerline, said method including the steps of:

selecting a depth in said wellbore for cementing a liner in place and for obtaining a seal of the cement with respect to the borehole wall upon curing of the cement;

determining, for each layer at said depth, the temperature differential values in a radial plane through said layers and surrounding earth formations between the respective temperature for each layer and the earth formations at a disturbed temperature condition in the wellbore relative to the quiescent temperature of each layer and the earth formation in quiescent temperature conditions;

utilizing a desired final contact stress value and the temperature differential values in an elastic strain analysis in respect to the layers of such liner, a liquid cement slurry and the earth formations in a radial plane for determining the finite pressure on a cement slurry that is required to obtain said desired final contact stress of the cemented wellbore annulus; and pumping a cement slurry into the wellbore annulus and at said selected depth, applying the finite pressure required to determining the final contact stress of the cement slurry after it reaches its set up point;

if the final contact stress is not positive, adjusting the pressure value to derive a positive final contact;

pumping the cement slurry into the wellbore annulus and at said selected depth;

applying pressure on the cement slurry at the pressure value required to obtain the desired positive contact stress at said selected depth.

2. The method as set forth in claim 1 wherein only the temperature differential value is changed and a temperature control liquid is circulated through the wellbore prior to pumping cement slurry to obtain the desired temperature differential.

3. A method for determining the cementing parameters for cementing a liner in a wellbore to effect a seal with a borehole wall in a wellbore traversing earth formations where the wellbore has a disturbed temperature condition relative to a quiescent temperature condition to define temperature differential values as a function of depth; said method including the steps of:

selecting at least one depth in said wellbore where a fluid isolation seal is desired between a cement annulus and the borehole wall and where the liner, the cement annulus and the earth formations define layers of different materials radially outward from the center line of the wellbore;

determining a cement slurry contact stress on the borehole wall prior to its reaching its initial set point where such determinate is derived from aximetric plane strain equations for radial stress and radial displacement in a radial plane by matching common stress values at the interfaces of said layers for each interface of said layers and utilizing the temperature differential values at said depth and a selected pressure value on the cement annulus prior to the initial set point of the cement together with established physical parameters for strain and displacement of said layers;

determining a final contact stress on the borehole wall at a time after the cement slurry would be past its initial set point; and adjusting the temperature value and the pressure value relative to one another at said selected depth to obtain said positive contact stress value of the cement after the cement would reach its initial set point at said selected depth.

4. A method for cementing a liner in a wellbore to effect a positive contact stress seal of a cemented wellbore annulus with a borehole wall and the liner where the wellbore traverses earth formations and defines a wellbore annulus and where the wellbore has a disturbed temperature condition caused by circulation of liquids in the wellbore and where said circulation causes a disturbed temperature condition relative to a normal operating temperature condition which establishes a temperature differential as a function of depth and where said liner, said cemented annulus and earth formations are included in radial layers of elements extending radially from a borehole centerline, said method including the steps of:

selecting a depth in said wellbore for cementing a liner in place and for obtaining a seal of the cement with respect to the borehole wall upon curing of the cement;

determining, for each layer at said depth, the temperature differential values in a radial plane through said layers and surrounding earth formations between the respective temperature for each layer and the earth formations at a disturbed temperature condition in the wellbore relative to said normal operating temperature of each layer and the earth formation;

utilizing a desired final positive contact stress value and the temperature differential values in an elastic strain analysis in respect to each layer in a radial plane for determining the finite pressure on a cement slurry that is required to obtain said desired final contact stress of the cemented wellbore annulus;

pumping a cement slurry into the wellbore annulus and at said selected depth, applying to the cement slurry, prior to its reaching a set up point, the finite pressure required to obtain the desired positive contact stress at said selected depth.

5. The method as set forth in claim 4 wherein the cemented wellbore extends over an interval which will have a top, middle and bottom point and further including the steps of determining for each of the top, middle and bottom point said temperature differential values for each of said layers and utilizing the desired positive contact stress value in said elastic strain analysis in respect to each of said layers for determining said finite pressure.

6. A method for cementing a liner in a wellbore to effect a positive contact stress seal of a cemented wellbore annulus with a borehole wall and the liner where the wellbore traverses earth formations and defines a wellbore annulus and where the wellbore has a disturbed temperature condition caused by circulation of liquids in the wellbore and where circulation causes a disturbed temperature condition relative to a normal operating temperature condition which establishes a temperature differential as a function of depth and where said liner, said cemented annulus and earth formations are included in radial layers of elements extending radially from a borehole centerline, said method including the steps of:

selecting a depth in said wellbore for cementing a liner in place and obtaining a seal with respect to the borehole wall;

determining, for each layer at said depth, the temperature differential values in a radial plane through said layers and surrounding earth formations between the respective temperature for each layer and the earth formations at a disturbed temperature condition in the wellbore relative to the said normal operating temperature of each layer and the earth formation in undisturbed temperature conditions;

utilizing a pressure value for the cement slurry prior to its reaching its initial set up point and the temperature differential values in an elastic strain analysis in respect to said layers in a radial plane for determining the contact stress of the cement slurry prior to reaching the set up point; and determining the final contact stress of the cement slurry after it reaches its set up point;

if the final contact stress is not positive, adjusting the pressure value to derive a positive final contact stress;

pumping the cement slurry into the wellbore annulus and at said selected depth;

applying pressure on the cement slurry at the pressure value or the adjusted pressure value required to obtain the desired positive contact stress at said selected depth.

7. A method for cementing a liner in a wellbore to effect a positive contact stress seal of a cemented wellbore annulus with a borehole wall and the liner where the wellbore traverses earth formations and defines a wellbore annulus and where the wellbore has a disturbed temperature condition caused by circulation of liquids in the wellbore and where circulation causes a disturbed temperature condition relative to a normal operating temperature condition which establishes a temperature differential as a function of depth and where said liner, said cemented annulus and earth formations are included in radial layers of elements extending radially from a borehole centerline, said method including the steps of:

selecting a depth in said wellbore for cementing a liner in place and obtaining a seal with respect to the borehole wall;

determining, for each layer at said depth, the temperature differential values in a radial plane through said layers and surrounding earth formations between the respective temperature for each layer and the earth formations at a disturbed temperature condition in the wellbore relative to the said normal operating temperature of each layer and the earth formation in undisturbed temperature conditions;

utilizing a pressure value for the cement slurry prior to its reaching its initial set up point and the temperature differential values in an elastic strain analysis in respect to said layers in a radial plane for determining the contact stress of the cement slurry prior to reaching the set up point; and determining the final contact stress of the cement slurry after it reaches its set up point;

if the final contact stress is not positive, adjusting the temperature differential value to derive a positive final contact stress;

circulating a temperature control liquid in the wellbore to adjust the temperature in the wellbore at said depth to the adjusted temperature differential value;

pumping the cement slurry into the wellbore annulus and at said selected depth;

applying pressure on the cement slurry at the pressure value or the adjusted pressure value required to obtain the desired positive contact stress at said selected depth.

8. A method for determining the cementing parameters for cementing a liner in a wellbore to effect a seal with a borehole wall in a wellbore traversing earth formations and defines a wellbore annulus and where the wellbore has a disturbed temperature condition caused by circulation of liquids in the wellbore and where circulation causes a disturbed temperature condition relative to a normal operating temperature condition to define temperature differential values as a function of depth; said method including the steps of:

selecting at least one depth in said wellbore where a fluid isolation seal is desired between a cement annulus in the wellbore annulus and the borehole wall and where there are layers of different materials extend radially outward from the center line of the wellbore;

determining a cement slurry contact stress on the borehole wall prior to its reaching its initial set point where such determinate is derived from aximetric strain equations for radial stress and radial displacement in a radial plane by matching common stress values at the interfaces of said layers for each interface of said layers and utilizing the temperature differential values at said depth and a selected pressure value on the cement annulus prior to the initial set point of the cement slurry together with established physical parameters for strain and displacement of said layers;

determining a final contact stress on the borehole wall at a time after the cement slurry would be past its initial set point; and adjusting the temperature value and the pressure value relative to one another at said selected depth to obtain said positive contact stress value of the cement after the cement would reach its initial set point at said selected depth.

9. A method for determining the cementing parameters for cementing a liner in a wellbore to effect a seal with a borehole wall in a wellbore traversing each formations, where the wellbore has a disturbed temperature condition relative to an existing temperature condition which define temperature differential values as a function of depth; said method including the steps of:

selecting at least one depth in said wellbore where a fluid isolation seal is desired between a cement annulus and the borehole wall and where the liner, the cement annulus and the earth formations define layers of different materials extending radially outward from the center line of the wellbore;

obtaining temperature differential values for said one depth;

selecting a pressure value for application to the cement annulus prior to the initial set point of the cement slurry;

determining a cement slurry contact stress value on the borehole wall where the cement annulus is between the liner and the borehole wall prior to the cement slurry reaching its initial set point where such cement slurry contact stress value is derived from aximetric plane strain equations for radial stress and radial displacement in a radial plane by matching common stress values at the interfaces of said layers for each interface of said layers with use of the temperature differential values at said depth and a pressure value on the cement annulus prior to the initial set point of the cement slurry together with established physical parameters for strain and displacement of said layers;

determining a final contact stress value on the borehole wall at a time after the cement slurry would be past its initial set point where such final contact stress value is derived from aximetric plane strain equations for radial stress and radial displacement in a radial plane by matching common stress values at the interfaces of said layers for each interface of said layers with use of the temperature differential values at said depth together with the volume change of the cement slurry upon setting and with the established physical parameters for strain and displacement of said layers; and adjusting the pressure value and the differential temperature value relative to one another to derive a positive final contact stress if the final contact stress is not positive.

10. The method as set forth in claim 9 and further including the step of adjusting the differential temperature value and the pressure value relative to one another at said selected one depth to obtain the positive final contact stress value of the cement after the cement would reach its initial set point at said selected depth.

11. The method as set forth in claim 9 wherein a cemented wellbore extends over an interval which will have a top, a middle and a bottom point, and further including the steps of:

determining, for each of the top, middle and bottom points of said wellbore, said temperature differential values for each of said layers and utilizing a positive contact stress value in said aximetric plain strain equations in respect to each of said layers for determining said pressure value.

* * * * *